US010691061B2

(12) United States Patent
Yasui

(10) Patent No.: US 10,691,061 B2
(45) Date of Patent: Jun. 23, 2020

(54) IMAGE FORMING APPARATUS HAVING AN ENGAGEMENT MECHANISM FOR A CARTRIDGE

(71) Applicant: CANON KABUSHIKI KAISHA, Tokyo (JP)

(72) Inventor: Ryota Yasui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/136,774

(22) Filed: Sep. 20, 2018

(65) Prior Publication Data

US 2019/0094795 A1 Mar. 28, 2019

(30) Foreign Application Priority Data

Sep. 25, 2017 (JP) ..... 2017-183511

(51) Int. Cl.
*G03G 15/08* (2006.01)
*G03G 21/18* (2006.01)
*G03G 21/16* (2006.01)

(52) U.S. Cl.
CPC ..... *G03G 21/181* (2013.01); *G03G 21/1647* (2013.01); *G03G 21/1807* (2013.01); *G03G 21/1842* (2013.01)

(58) Field of Classification Search
USPC ..... 399/111
See application file for complete search history.

(56) References Cited

U.S. PATENT DOCUMENTS 8,086,135 B2 * 12/2011 Hashimoto ..... G03G 21/186 399/111
8,290,396 B2 * 10/2012 Lee ..... G03G 21/1661 399/110
2016/0216684 A1 * 7/2016 Kobayashi ..... G03G 21/1647

FOREIGN PATENT DOCUMENTS

JP 2016-133762 A 7/2016

* cited by examiner

*Primary Examiner* — Quana Grainger
(74) *Attorney, Agent, or Firm* — Venable LLP

(57) ABSTRACT

An image forming apparatus includes a main assembly, a cartridge, a rotationally movable member, an engaging portion, and a flexible member integrally including a first supported portion, a second supported portion, and a regulating portion. A position of the regulating portion of the flexible member relative to the engaging portion is changeable by a change in a flexed state of a portion of the flexible member between the first supported portion and the second supported portion, in interrelation with a change in relative position between the first supported portion and the second supported portion with rotational movement of the rotationally movable member When the rotationally movable member is in the first position, the regulating portion is in a regulating position to limit the elastic deformation of the engaging portion.

13 Claims, 12 Drawing Sheets

IMAGE FORMING APPARATUS HAVING AN ENGAGEMENT MECHANISM FOR A CARTRIDGE

FIELD OF THE INVENTION AND RELATED ART

The present invention relates an image forming apparatus, such as a copying machine, a facsimile machine or a printer, for forming an image by an electrophotographic process, an electrostatic recording process, or the like.

Conventionally, in the image forming apparatus using the electrophotographic process, a process cartridge type in which a photosensitive drum and a process unit actable on the photosensitive drum are integrally assembled into a cartridge and this cartridge is mountable to and dismountable from an image forming apparatus main assembly is employed. In such a process cartridge, there is a drum cartridge in which the photosensitive drum and a cleaning member or the like are integrally assembled into a unit. Further, a developing cartridge in which a developing sleeve and an accommodating container for accommodating toner, or the like are integrally assembled into a unit, or a cartridge in which the drum cartridge and the developing cartridge are integrally connected with each other, and the like cartridge have been known.

In the case where such a process cartridge type is used, in general, a constitution in which an engaging member of the apparatus main assembly and the cartridge are engaged with each other with a mounting operation of the cartridge into the apparatus main assembly and the cartridge is positioned in a mounting position in the apparatus main assembly is employed. Thus, in the case where the cartridge and the apparatus main assembly are engaged with each other with the mounting operation of the cartridge, when an engaging force of the engaging member is excessively strong operativity during mounting and dismounting of the cartridge becomes poor. Accordingly, in order to improve the operativity, it is desired that the cartridge is mountable to and dismountable from the apparatus main assembly with a light force. However, in the case where the cartridge is mountable to and dismountable from the apparatus main assembly with the light force, when package shipment such that the image forming apparatus is shipped in a state in which the cartridge is mounted in the apparatus main assembly, there is a liability that the cartridge is moved from the mounting position due to vibration, impact and the like thereof during transportation.

Therefore, Japanese Laid-Open Patent Application (JP-A) 2016-133762 has proposed a constitution in which a regulating member for causing engagement between the apparatus main assembly and the cartridge engaged with the apparatus main assembly by the engaging member provided in the apparatus main assembly not to be readily eliminated is provided. In JP-A 2016-133762, in interrelation with a door opened and closed during mounting and dismounting of the cartridge, the regulating member is moved between a position where the regulating member prevents movement of the engaging member and a position where the regulating member permits the movement of the engaging member. Specifically, a constitution in which a slidable member sliding in interrelation with the door is provided, and in interrelation with movement of this slidable member, the regulating member is moved is employed.

However, in the constitution, a plurality of component parts such as slidable members are interposed between the door and the regulating member, and therefore, a constitution for limiting an engaging state between the cartridge and the apparatus main assembly became complicated.

SUMMARY OF THE INVENTION

In view of the above-described problem, a principal object of the present invention is to provide an image forming apparatus capable of properly limiting engagement between a cartridge and an apparatus main assembly with a simple constitution.

According to an aspect of the present invention, there is provided an image forming apparatus comprising: a main assembly including a main assembly connecting portion and a driving source configured to generate a driving force for rotating the main assembly connecting portion; a cartridge including a cartridge connecting portion configured to connect with the main assembly connecting portion, and a rotatable member carrying a developer and configured to rotate by receiving the driving force through the cartridge connecting portion, wherein the cartridge is mountable to and dismountable from the main assembly by being inserted into and extracting out of the main assembly in a rotational axis direction of the rotatable member; a rotationally movable member mounted in the main assembly so as to be rotationally moved between a first position located on an insertion and extraction path of the cartridge and a second position retracted from the insertion and extraction path; an engaging portion provided in the main assembly and engageable with the cartridge on the insertion and extraction path so that the cartridge is in a mounting position where the main assembly connecting portion and the cartridge connecting portion connect with each other in an insertion and extraction direction of the cartridge, wherein the engaging portion is elastically deformable so as to be retracted from the insertion and extraction path; and a flexible member integrally including a first supported portion supported by the rotationally movable member, a second supported portion supported by the main assembly, and a regulating portion configured to limit elastic deformation of the engaging portion in contact with the engaging portion, wherein a position of the regulating portion of the flexible member relative to the engaging portion is changeable by a change in a flexed state of a portion of the flexible member between the first supported portion and the second supported portion, in interrelation with a change in relative position between the first supported portion and the second supported portion with rotational movement of the rotationally movable member, wherein when the rotationally movable member is in the first position, the regulating portion is in a regulating position to limit the elastic deformation of the engaging portion.

The image forming apparatus according to the present invention is capable of properly carrying out engagement and elimination of the engagement between the cartridge and the apparatus main assembly by the regulating member.

Further features of the present invention will become apparent from the following description of exemplary embodiments with reference to the attached drawings.

DESCRIPTION OF THE EMBODIMENTS

Figure 1:
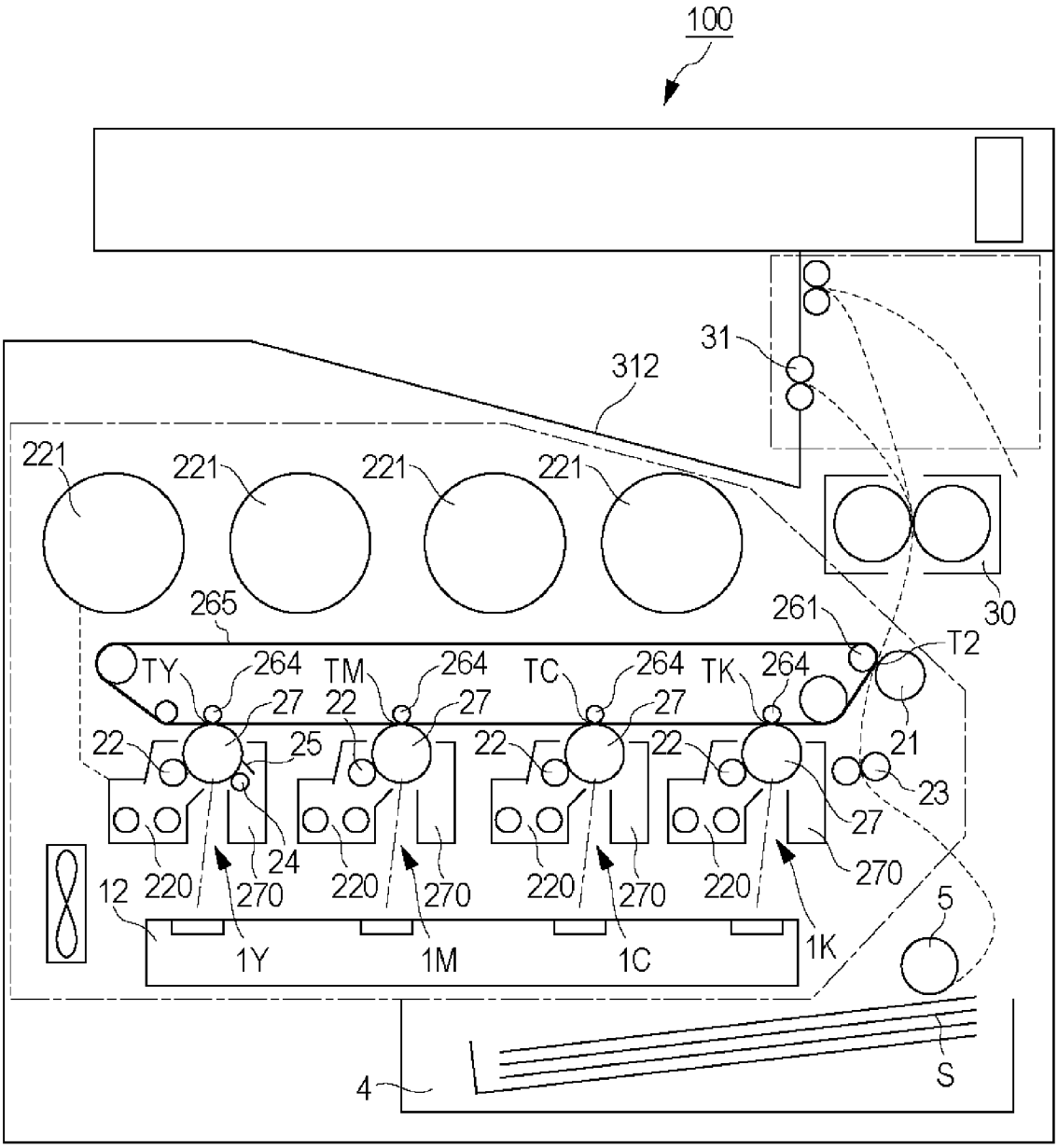
FIG. 1 is a schematic sectional view of an image forming apparatus.

Embodiments of the present invention will be described in detail with reference to the drawings. Incidentally, the following embodiments do not limit the present invention according to the claims, and all combinations of features described in the embodiments are not necessarily essential to means for solving the problem of the present invention. Incidentally, members common to the respective figures are represented by the same reference numerals or symbols.

First Embodiment (Image Forming Apparatus)

FIG. 1 is an illustration of a structure of an image forming apparatus 100. As shown in FIG. 1, the image forming apparatus 100 is an intermediary transfer type full color printer of a tandem type in which image forming portions 1Y, 1M, 1C and 1K are arranged along a surface of an intermediary transfer belt 265.

At the image forming portion 1Y, a yellow toner image is formed on a photosensitive drum 27(Y) and then is transferred at a transfer portion TY onto the intermediary transfer belt 265. At the image forming portion 1M, a magenta toner image is formed on a photosensitive drum 27(M) and then is transferred at a transfer portion TM onto the intermediary transfer belt 265. At the image forming portions 1C and 1K, cyan and black toner images are formed on photosensitive drums 27(C) and 27(K), respectively, and then are transferred at transfer portions TC and TK onto the intermediary transfer belt 265. Image forming processes for respective colors are carried out at timings when the toner images are superposed on the upstream-side toner image(s) temporarily transferred on the intermediary transfer belt 265. As a result, on the intermediary transfer belt 265, a full-color toner image is formed.

The four color toner images transferred on the intermediary transfer belt 265 are conveyed to a secondary transfer portion T2 and are secondary-transferred onto a recording material S. A separation roller 5 separates sheets of the recording material S, one by one, extracted out of a recording material cassette 4, and then feeds the recording material S to a registration roller pair 23. The registration roller pair 23 sends the recording material S to the secondary transfer portion T2 while being timed to the toner images on the intermediary transfer belt 265. The recording material S on which the four color toner images are secondary-transferred is pressed and heated by a fixing device 30, so that the toner images are fixed on a surface of the recording material S. Thereafter, the recording material S is discharged on a discharge tray 312 by a discharging roller pair 31. A toner cartridge 221 is provided for each of colors of yellow, magenta, cyan and black, and supplies a toner to a developing cartridge 220.

The image forming portions 1Y, 1M, 1C and 1K have the substantially same constitution except that colors of toners used in associated developing cartridges 220, respectively, are yellow, magenta, cyan and black, respectively, which are different from each other. In the following, the image forming portion is described as an image forming portion 1, and redundant explanation about the image forming portions 1Y, 1M, 1C and 1K will be omitted.

The image forming portion 1 includes, at a periphery of the photosensitive drum 27, a charging roller 24, an exposure device 12, the developing cartridge 220, a transfer roller 264 and a cleaning blade 25. The photosensitive drum 27 rotates at a predetermined process speed.

The charging roller 24 electrically charges a surface of the photosensitive drum 27 to a negative potential uniformly. The exposure device 12 scans the surface of the photosensitive drum 27 with a laser beam, obtained by ON-OFF modulation of a scanning line image signal developed from an associated color image data, through a rotating mirror, so that an electrostatic image for an image is formed on the surface of the photosensitive drum 27. The developing cartridge 220 develops the electrostatic image into a toner image as a developer image by transferring the toner onto the photosensitive drum 27 by a developing sleeve 22. The transfer roller 264 transfers the toner image from the photosensitive drum 27 onto the intermediary transfer belt 265. The cleaning blade 25 removes a transfer residual toner by sliding on the photosensitive drum 27.

(Image Forming Portion)

Next, a structure of the image forming portion will be described using FIGS. 1 and 2.

Figure 2:
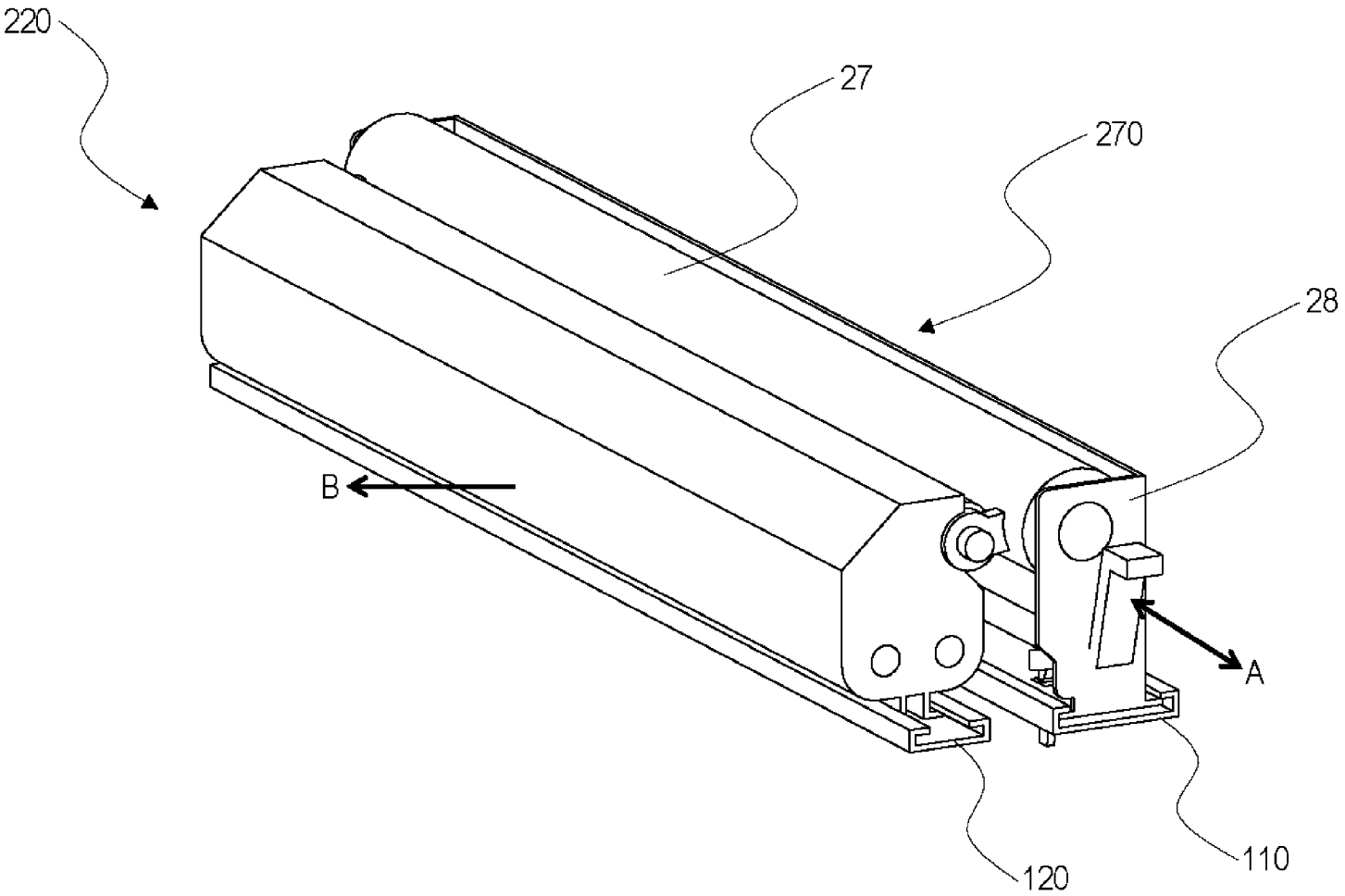
FIG. 2 is a perspective view of an outer appearance of an image forming portion.
Figure 3:
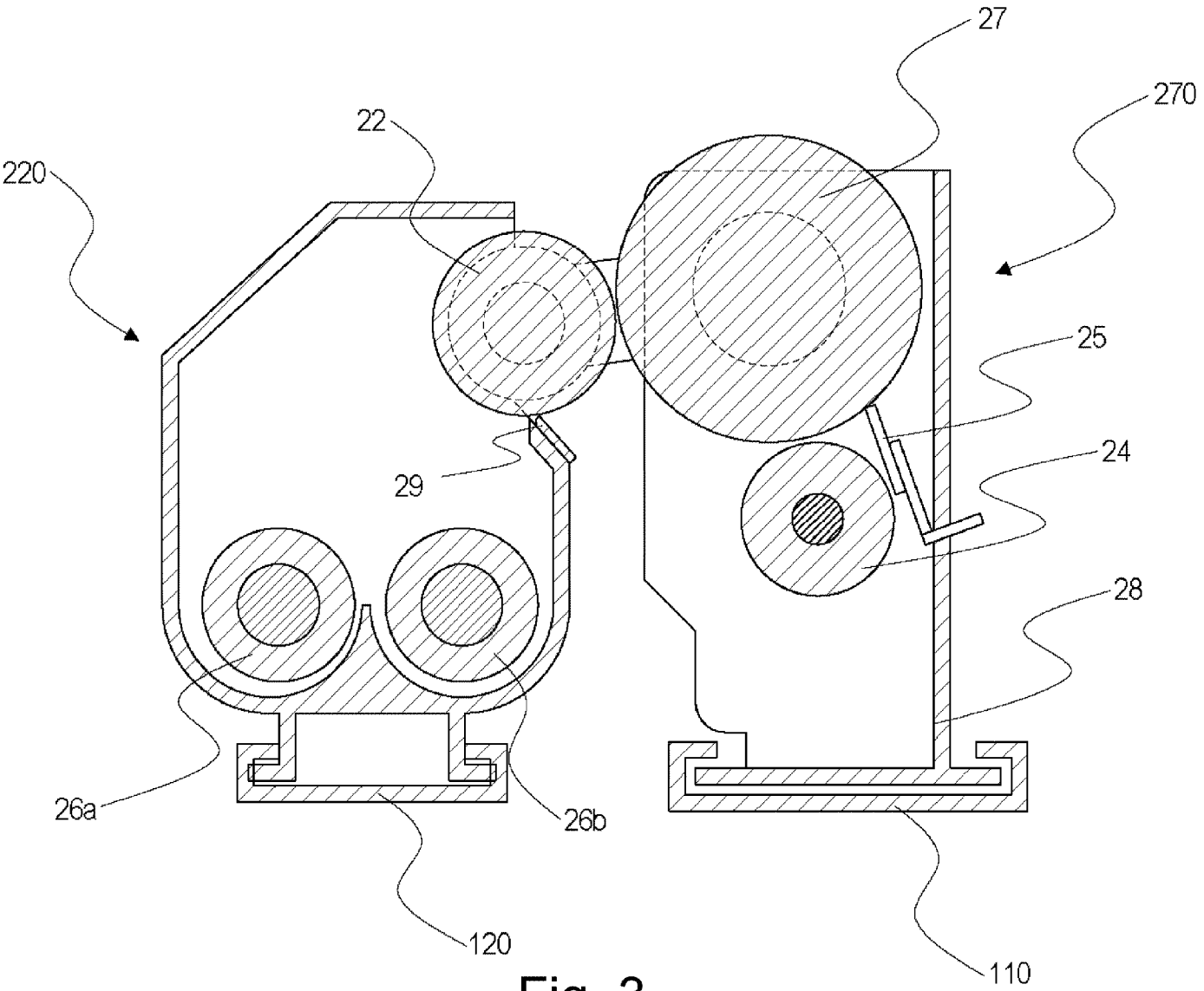
FIG. 3 is a perspective view of an image forming portion.

FIG. 2 is a perspective view of the image forming portion 1. FIG. 3 is a sectional view of the image forming portion 1. In FIG. 3, an engaging constitution between a drum cartridge 270 described later and the image forming apparatus main assembly 100 is omitted. As shown in FIG. 2, the image forming portion is constituted by the drum cartridge 270 and the developing cartridge 220 with a drum cartridge 270. The drum cartridge 270 and the developing cartridge 220 are individually exchangeable, and each thereof is mountable to and dismountable from the image forming apparatus main assembly 100. When the drum cartridge 270 and the developing cartridge 220 are mounted and dismounted, they are guided by a drum cartridge rail 110 and a developing (cartridge) rail 120, respectively, and are constituted so as to be inserted and extracted in an arrow A direction which is a rotational axis direction of the photosensitive drum 27.

Further, in the case where the drum cartridge 270 or the developing cartridge 220 is mounted in and dismounted from the image forming apparatus main assembly 100, the developing cartridge 220 is constituted so as to be retracted in an arrow B direction by an unshown retracting mechanism. By this constitution, a clearance between the cartridges is ensured, so that when the drum cartridge 270 or the developing cartridge 220 is inserted into and extracted out of the apparatus main assembly 100, the photosensitive drum 27 or the developing sleeve 22 is prevented from being damaged. Each of the drum cartridge 270 and the developing cartridge 220 is an example of the cartridge.

(Drum Cartridge)

As shown in FIG. 3, the drum cartridge 270 in this embodiment forms an exchangeable unit in which the photosensitive drum 27, the charging roller 24 and the cleaning blade 25 are accommodated in a photosensitive drum casing 28 and are integrally mounted in and dismounted from the image forming apparatus main assembly 100. The photosensitive drum 27 and the charging roller 24 are rotatably supported by the photosensitive drum casing 28, and the charging roller 24 and the cleaning blade 25 are supported by the photosensitive drum casing 28 in a state of being pressed against the photosensitive drum 27.

The charging roller 24 is pressed against the photosensitive drum 27 and therefore is rotated by rotation of the photosensitive drum 27. The photosensitive drum 27 is an example of a rotatable member.

The performance of the photosensitive drum 27, the charging roller 24 and the cleaning blade 25 are gradually reduced as image forming operations are cumulatively carried out, and therefore, the drum cartridge 270 is required to be exchanged when the performance has reduced to a predetermined stage. Accordingly, the drum cartridge 270 has such a constitution that the drum cartridge 270 is exchangeable by being extracted out of and inserted into the image forming apparatus main assembly 100 in the arrow A direction (FIG. 2) as described above.

When the drum cartridge 270 is inserted into and extracted out of the image forming apparatus main assembly 100, the drum cartridge 270 is guided by the drum cartridge rail 110 provided in the image forming apparatus main assembly 100 and is movable in the arrow A direction. Further, the drum cartridge 270 is extracted out of the rear side toward the front side of the image forming apparatus main assembly 100 shown in FIG. 1 and then is taken out of the image forming apparatus main assembly 100. Then, the drum cartridge 270 is moved from the front side to the rear side, so that the drum cartridge 270 is inserted into the image forming apparatus main assembly 100 and thus is mounted at a mounting position of the apparatus main assembly. A front-rear direction is the arrow A direction shown in FIG. 2 and is also an insertion and extraction direction and is mounting and dismounting direction.

Further, the photosensitive drum 27 is rotated by transmission of a driving force from a driving source thereto though an unshown driving coupling (main assembly connecting portion) provided in the image forming apparatus main assembly 100. Here, the driving source and the photosensitive drum 27 are constituted so that the driving force can be transmitted to the photosensitive drum 27 by connecting the unshown driving cartridge and an unshown cartridge coupling (cartridge connecting portion) through mounting of the drum cartridge 270 in the mounting position of the image forming apparatus main assembly 100 and so that the connection is eliminated by dismounting the drum cartridge 270 from the image forming apparatus main assembly 100.

(Developing Cartridge)

As shown in FIG. 3, the developing cartridge 220 in this embodiment is a developing device of a type using a two-component developer and includes the developing sleeve 22 for developing the electrostatic latent image into the toner image on the photosensitive drum 27.

The developing sleeve 22 is provided with bearings, at both ends thereof with respect to an axial direction, as a gap forming member with the photosensitive drum 27 and is rotatably held in a state in which a distance from the photosensitive drum 27 is kept at a certain gap. The developing sleeve 22 is constituted so as to develop the electrostatic latent image, formed on the photosensitive drum 27, at a developing position where the photosensitive drum 27 and the developing sleeve 22 oppose each other.

Further, the developing cartridge 220 includes feeding screws **26*a* and 26*b* for feeding the developer supplied from the toner cartridge 221 to the developing sleeve 22. The developing sleeve 22** is an example of a rotatable member.

Further, inside the developing cartridge 220, a developing blade 29 for regulating a layer thickness of the toner on the developing sleeve 22 at a certain level. A gap (SB gap) between a free end of the developing blade 29 and the developing sleeve 22 is precisely adjusted in a manufacturing step.

Similarly as in the case of the drum cartridge 270, the developing cartridge 220 is required to be exchanged depending on a degree of a reduction in performance. Accordingly, as in the case of the drum cartridge 270, when the developing cartridge 220 is inserted into and extracted out of the image forming apparatus main assembly 100, the developing cartridge 220 is guided by the developing rail 120, so that the developing cartridge 220 can be moved in the arrow A direction.

(Mounted State of Drum Cartridge in Image Forming Apparatus Main Assembly)

Next, using FIGS. 4 to 8, the mounted state of the drum cartridge 270 in the image forming apparatus main assembly 100 will be described.

Figure 4:
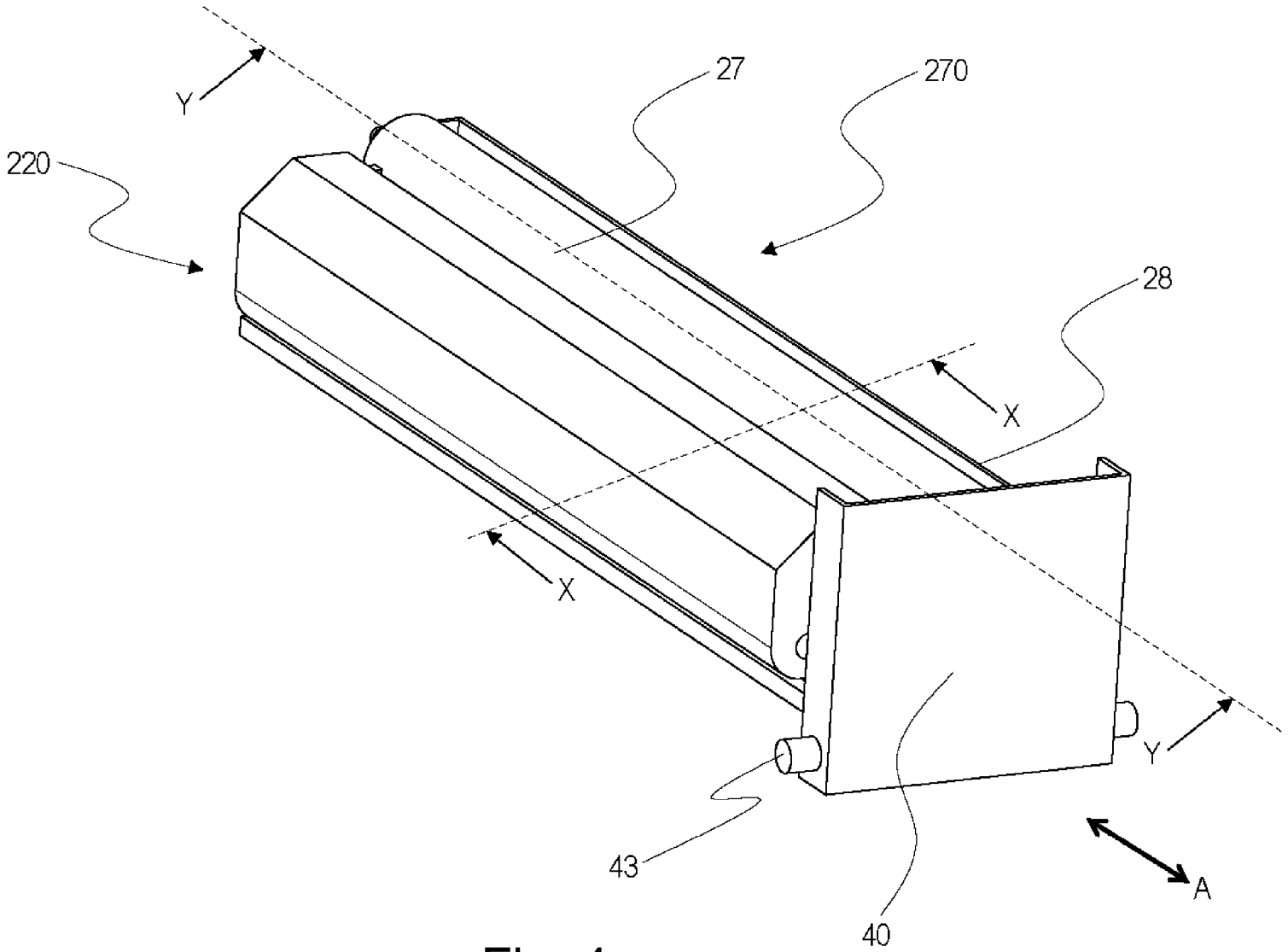
FIG. 4 is a schematic perspective view showing a state in which a drum cartridge is mounted in the image forming apparatus main assembly.

FIG. 4 is a schematic perspective view showing a state in which the drum cartridge 270 is mounted in the image forming apparatus main assembly 100.

As shown in FIG. 4, the image forming apparatus main assembly 100 is provided with a small door 40 capable of opening and closing an opening through which an operator has access to the drum cartridge 270 and the developing cartridge 220. This small door 40 is rotated about a door rotation shaft 43 as a rotation center relative to the image forming apparatus main assembly 100 and is capable of opening and closing the opening of the image forming apparatus main assembly 100. Further, by opening the small door 40, the drum cartridge 270 or the developing cartridge 220 is capable of being inserted and extracted in the arrow A direction. This small door 40 is provided inside an unshown outer casing cover portion of the image forming apparatus main assembly 100.

Accordingly, the operator has access to the drum cartridge 270 and the developing cartridge 220 first by dismounting the outer casing cover portion of the apparatus main assembly and then by opening the small door 40. Further, a position where the small door 40 is in a closed state and which is on an insertion and extraction path of the drum cartridge 270 and the developing cartridge 220 is a first position, and a position where the small door 40 is in an open state and which is retracted from the insertion and extraction path of the drum cartridge 270 and the developing cartridge 220 is a second position. The small door 40 is an example of a rotationally movable member. In this embodiment, in the case where the drum cartridge 270 is mounted, the drum cartridge 270 is constituted so as to be locked by and positioned relative to the image forming apparatus 100. By this positioning, movement of the drum cartridge 270 in the arrow A direction in the image forming apparatus main assembly 100 is prevented.

This positioning is carried out for preventing the drum cartridge 270 from moving from the mounted position of the image forming apparatus main assembly 100 when the image forming apparatus is shipped in a state in which the drum cartridge 270 is mounted in and packed with the image forming apparatus main assembly 100.

Figure 5:
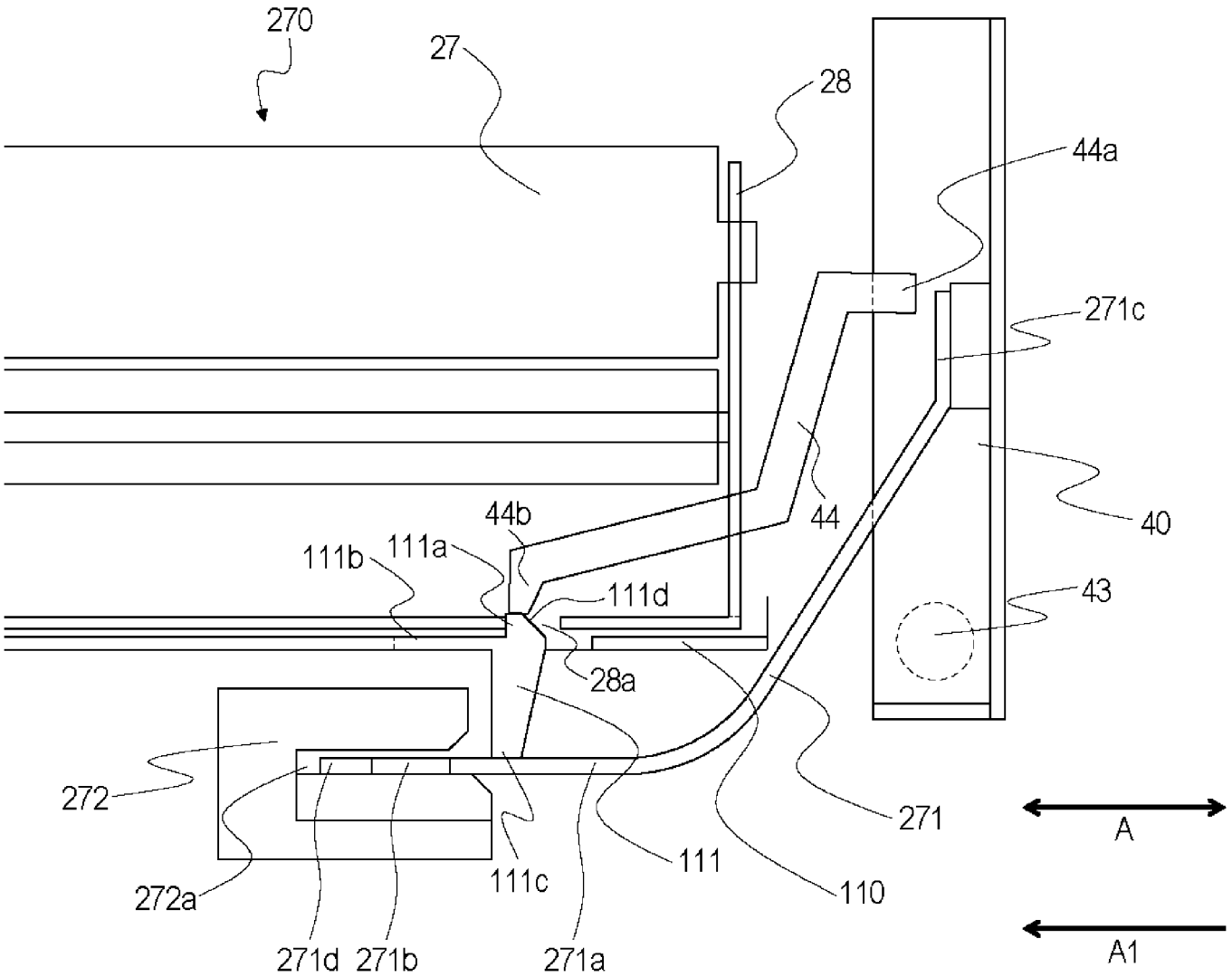
FIG. 5 is a sectional view showing a mounted state of the drum cartridge.
Figure 6:
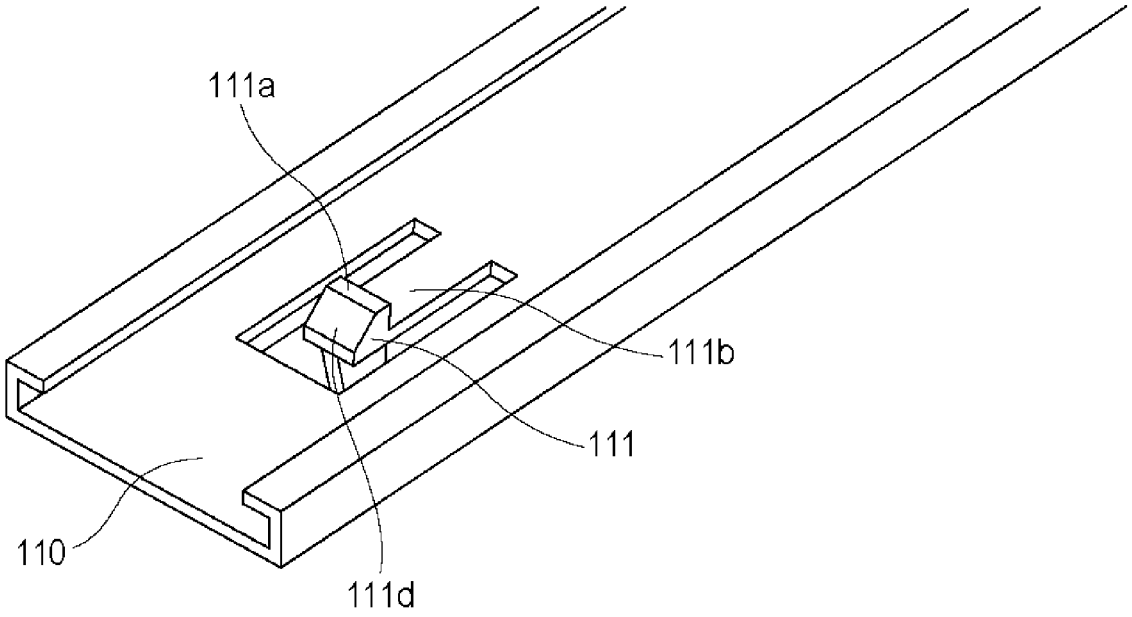
FIG. 6 is an enlarged perspective view showing a part of a drum cartridge rail.
Figure 7:
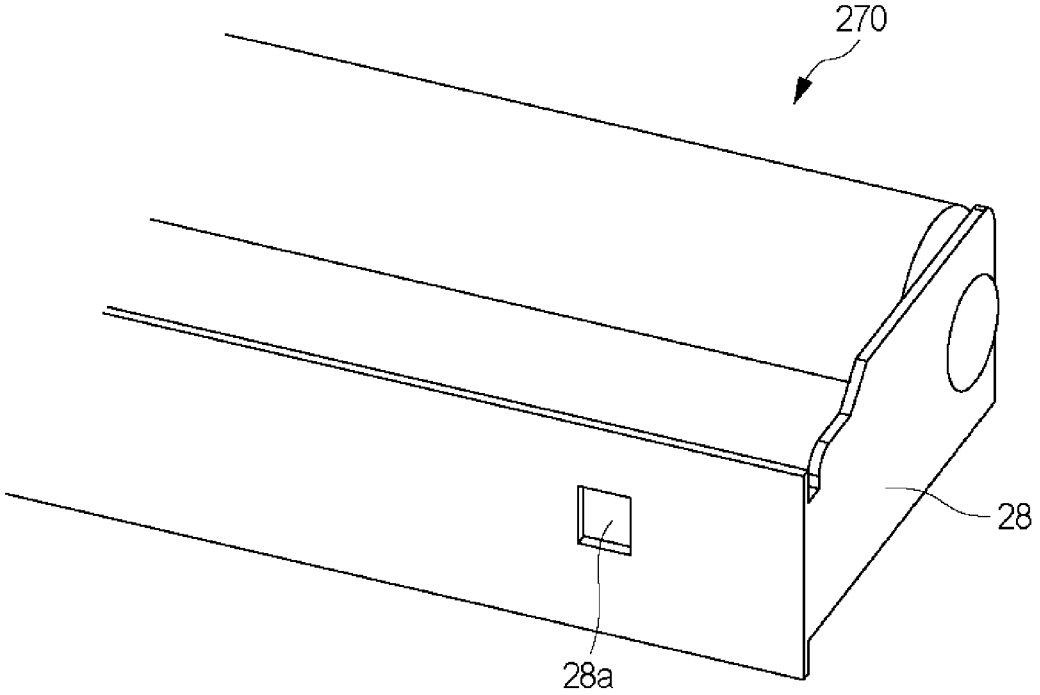
FIG. 7 is an enlarged perspective view showing a part of the drum cartridge.
Figure 8:
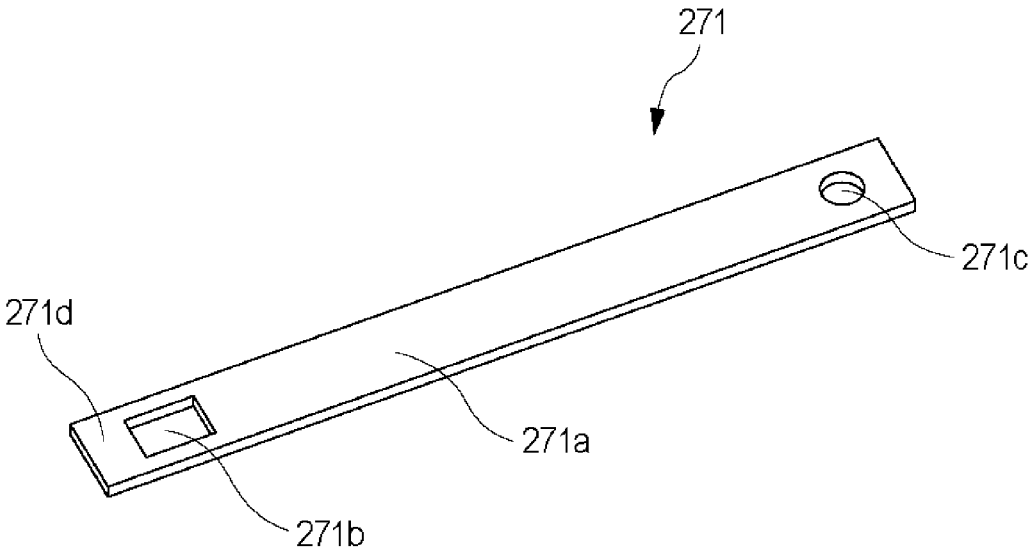
FIG. 8 is a perspective view showing a regulating member.

Next, a constitution of the positioning between the image forming apparatus main assembly 100 and the drum cartridge 270 will be described using FIGS. 5 to 7. FIG. 5 is a sectional view showing the mounted state of the drum cartridge 270 and a Y-Y cross-section of FIG. 4. FIG. 6 is an enlarged perspective view showing a part of the drum cartridge rail 110. FIG. 7 is an enlarged perspective view showing a part of the drum cartridge rail 110. FIG. 8 is a perspective view having a structure of a regulating member 271.

As shown in FIGS. 5 and 6, the drum cartridge rail 110 of the image forming apparatus main assembly 100 is provided with an elastic engaging portion 111 having a projection shape by snap-fitting or the like, for example, this engaging portion 111 is formed integrally with the drum cartridge rail 110 by cutting away the drum cartridge rail 110 in a channel shape.

The engaging portion 111 includes an engaging projection 111*a* projecting toward above the drum cartridge rail 110, a flexible portion 111*b* for connecting the engaging projection 110*a* with the drum cartridge rail 110, a contact portion 111*c* projecting toward below the drum cartridge rail 110, and an inclined portion 111*d* inclined relative to the drum cartridge rail 110.

The engaging projection 111*a* projects in a direction crossing the insertion and extraction direction of the drum cartridge 270 so as to engage with the drum cartridge 270 by being engaged in a recessed portion 28*a* of the drum cartridge 270 when the drum cartridge 270 is mounted in the apparatus main assembly. Thus, by engagement of the engaging projection 111*a* in the recessed portion 28*a* specifically described later, the drum cartridge 270 is located in the mounting position of the image forming apparatus main assembly 100.

The flexible portion 111*b* connects the drum cartridge rail 110 and the engaging portion 111*a* and is provided in a thin plate shape inside a channel-shaped cut-away portion of the drum cartridge rail 111. Further, the flexible portion 111*b* is formed in the thin plate shape so that a length thereof with respect to a direction perpendicular to the mounting and dismounting direction of the drum cartridge 270 becomes short.

As a result, when the drum cartridge 270 is mounted into and dismounted from the apparatus main assembly, the flexible portion 111*b* is elastically deformable so that the engaging projection 111*a* moves relative to the drum cartridge rail 111 in a direction crossing the insertion and extraction direction of the drum cartridge 270. That is, a constitution in which the flexible portion 111*a* moves in the direction crossing the insertion and extraction direction by being elastically deformed relative to the drum cartridge rail 110 and thus the engaging projection 111*a* moves in a direction of being retracted from the recessed portion 28*a* eliminating engagement of the drum cartridge 270 with the image forming apparatus main assembly 100 is employed.

The contact portion 111*c* that projects in a direction below the drum cartridge rail 110 is movable together with the engaging projection 111*a* in the direction crossing the insertion and extraction direction of the drum cartridge 270. Further, in the case where the small door 40 is in an open state, when the flexible portion 111*b* is elastically deformed, the contact portion 111*c* is contactable to the regulating member 271.

The inclined portion 111*d* has an inclined surface positioned on the insertion and extraction path of the drum cartridge 270. As a result, with a mounting operation of the drum cartridge 270, a bottom of the photosensitive drum casing 28 and the inclined portion 111*d* contact each other. Then, the inclined portion 111*d* is pushed down by the contact with the bottom (surface) of the photosensitive drum casing 28, so that the flexible portion 111*b* is elastically deformed in a direction crossing the mounting direction of the drum cartridge 270.

By this elastic deformation of the flexible portion 111*b*, the engaging projection portion 111*a* moves from the engaging position to the retracted position in the direction crossing the mounting and dismounting direction. The engaging portion 111 is an example of a positioning portion, and the engaging projection portion 111*a* is an example of an engaging portion. In this embodiment, the drum cartridge rail 110 is formed of a PC+ABS resin material which is consisting of a mixture of polycarbonate resin and ABS resin. Further, a material of the drum cartridge rail 110 may also be another material when a constitution in which the engaging projection portion 111*a* can flex in the direction crossing the mounting and dismounting direction.

Further, at the bottom of the photosensitive drum casing 28 of the drum cartridge 270, as shown in FIGS. 5 and 7, the recessed portion 28*a* engageable with the engaging projection 111*a* of the engaging portion 111 is provided. The recessed portion 28*a* is provided at a position which is the bottom of the drum cartridge 270 and which passes the engaging projection 111*a* when the drum cartridge 270 is mounted in the image forming apparatus main assembly 100.

Then, by engagement between the recessed portion 28*a* and the engaging projection 111*a*, the drum cartridge 270 is located in the mounting position in the image forming apparatus main assembly 100. At this time, the mounting position refers to a position where drive transmission is enabled by the unshown driving source when the drum cartridge 270 is mounted in the image forming apparatus main assembly 100.

Further, as shown in FIGS. 5 and 8, in the image forming apparatus main assembly 100, the regulating member 271 for preventing movement of the engaging portion in a direction crossing the mounting and dismounting direction of the drum cartridge 270 is provided. The regulating member 271 is an example of the flexible member.

The regulating member 271 includes a regulating portion 271*a*, contactable to the contact portion 111*c*, for preventing movement of the engaging projection portion 111*a* by elastic deformation of the flexible portion 111*b*, and includes a regulation (prevention) eliminating portion 271*b* for eliminating the prevention of the movement, a fixing portion 271*c* fixedly supported by the small door 40, and a supporting portion 271*d* supported movably by a supporting member 272. Here, the fixing portion 271*c* is an example of a first portion-to-be-supported, and the supporting portion 271*d* is an example of a second portion-to-be-supported.

As shown in FIG. 8, the regulation eliminating portion 271*b* has a hole shape provided in a size through which the contact portion 111*c* can pass and is provided on a locus along which the engaging projection 111*a* of the engaging portion 111 including the flexible portion 111*b* can be elastically deformed in a state in which the small door 40 opens. The regulation eliminating portion 271*b* is an example of a hole.

Further, as shown in FIG. 5, the regulating member 271 is constituted so as to be fixed and supported by engaging the fixing portion 271*c* as one end thereof in an unshown boss provided on the small door 40. Further, a constitution in which the supporting portion 271*d* as the other end of the regulating member 271 is slidable (movable) on a supporting surface 272*a* of the supporting member 272 in the arrow A direction, which is the insertion and extraction direction of the drum cartridge 270, by the opening and closing operation of the small door 40 is employed. Accordingly, the regulating member 271 is constituted so as to slide (move) relative to the image forming apparatus main assembly 100 by an opening and closing operation of the small door 40. Incidentally, the supporting portion 271*d* has a sufficient length with respect to the arrow A direction so that the supporting portion 271*d* is not dismounted from the supporting surface 272*a* of the supporting member 272 by the opening and closing operation of the small door 40.

Further, the supporting member 272 is provided in the image forming apparatus main assembly 100 and is disposed below the drum cartridge rail 110 and the engaging portion 111 on a side below the rotation shaft 43 of the small door 40 with respect to a vertical direction. Further, the fixing portion 271*c* is provided above the rotation shaft 43 of the small door 40 with respect to the vertical direction on a side above the engaging portion 111 with respect to the vertical direction. With respect to the insertion and extraction direction, the supporting member 272 is provided inside the engaging portion 111 in the image forming apparatus main assembly 100, and the rotation shaft 43 of the small door 40 and the fixing portion 271*c* are provided outside the engaging portion 111 in the image forming apparatus main assembly 100.

In this embodiment, the regulating member 271 is supported by the small door 40 and the supporting member 272 in a state in which the regulating member 271 is flexed between the small door 40 and the supporting member 272 by the fixing portion 271*c* and the supporting portion 271*d*. Further, a relative position between the fixing portion 271*c* and the supporting portion 271*d* is changed by the rotation of the small door 40, whereby a flexed state of the regulating member 271 is changed, so that the regulating portion 271*a* moves relative to the engaging portion 111*a*.

Accordingly, in interrelation with an opening operation of the small door 40, a state of the regulating member 271 shifts from a limiting state to a limitation (prevention)-eliminated state. Here, the limiting state is, as shown in FIG. 5, a state in which the regulating portion 271*a* of the regulating member 271 contacts the contact portion 111*c* of the engaging portion 111 and elastic deformation of the flexible portion 111*b* toward a side where engagement of the engaging portion 111 is eliminated is limited. Further, the limiting state refers to a state in which the regulating member 271 is in the regulating position.

In the limiting state, the elastic deformation of the flexible portion 111*b* is limited, and therefore, movement of the engaging portion 111 is prevented and engagement between the engaging projection 111*a* and the recessed portion 28*a* is not eliminated.

Figure 9:
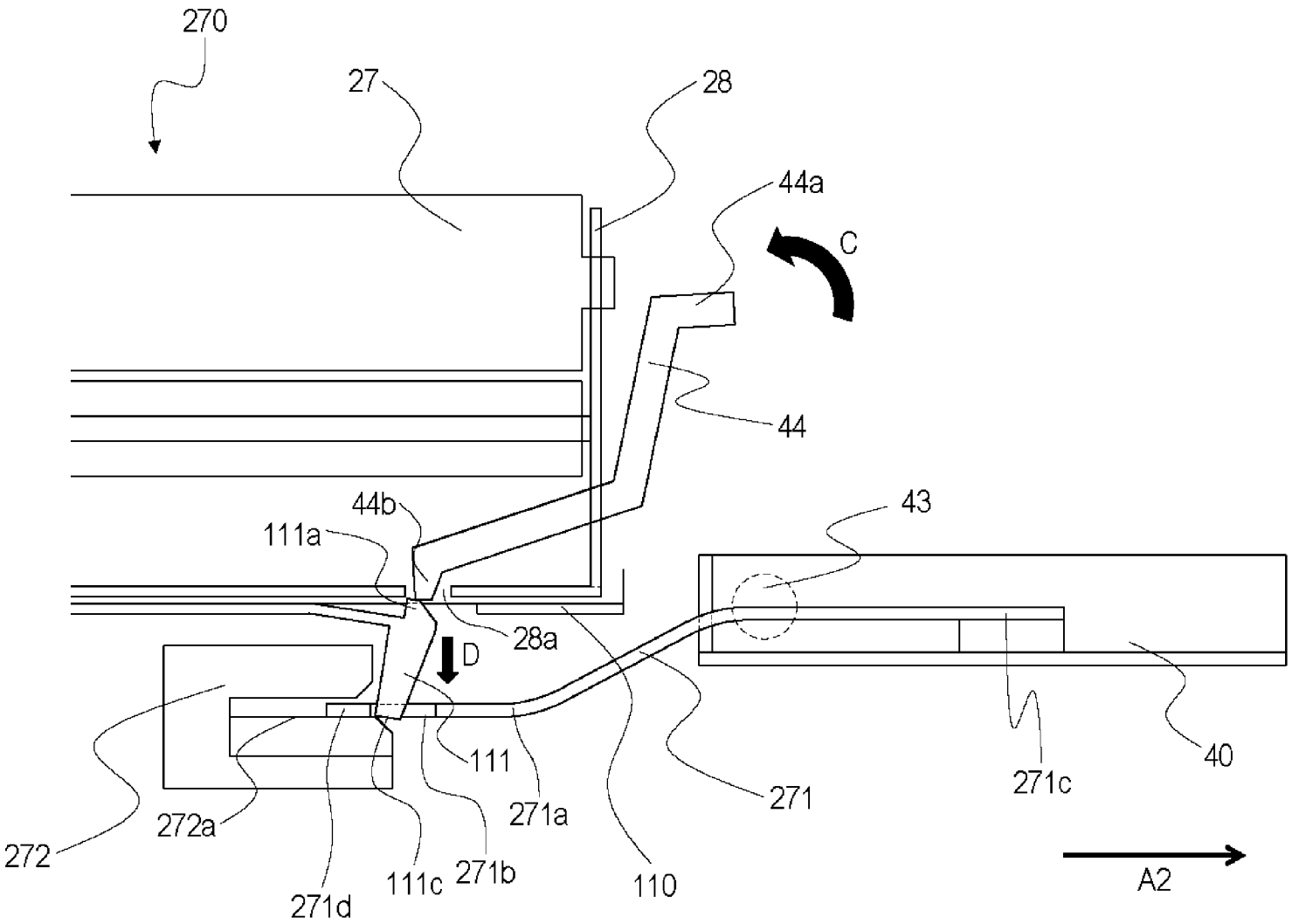
FIG. 9 is a sectional view showing a state in which the drum cartridge is dismountable from the image forming apparatus main assembly.

On the other hand, the regulation-eliminated state is, as shown in FIG. 9 described later, a state in which the regulating portion 271*a* is retracted, and the contact portion 111*c* of the engaging portion 111 and the regulation eliminating portion 271*b* of the regulating member 271 oppose each other and thus the elastic deformation of the flexible portion 111*b* is not limited. In the limitation-eliminated state, the flexible portion 111*b* is elastically deformable, and therefore, the contact portion 111*c* engages in the regulation eliminating portion 271*b* and the engagement between the engaging projection 111*a* and the recessed portion 28*a* can be eliminated.

Thus, the regulating member 271 prevents the movement of the engaging portion 111, so that the movement of the drum cartridge 270 in the image forming apparatus main assembly 100 is prevented through the engaging portion 111.

In this embodiment, the regulating member 271 is constituted by a flexible film member. Incidentally, a material of the regulating member may desirably be a material such as polypropylene and may preferably have flexural strength of 40-60 MPa, but may also be not limited thereto when the material is constituted so as to be slidable with the opening and closing operation of the small door 40.

Further, the drum cartridge 270 is provided with an operation handle 44 to be gripped by a user or a maintenance person when the drum cartridge 270 is mounted in and dismounted from the image forming apparatus main assembly 100. The operation handle 44 is an example of an operating portion. The operation handle 44 has an unshown rotation center and, as shown in FIG. 5, maintains an attitude such that the engagement between the engaging portion 111 and the recessed portion 28*a* is not eliminated by a self-weight thereof. Here, the operation handle 44 may also have a constitution in which the attitude as shown in FIG. 5 is maintained by an elastic member such as a spring when the constitution eliminates the engagement between the engaging portion 111 and the recessed portion 28*a* by gripping a grip portion 44*a* of the operation handle 44. Further, the operation handle 44 may also be not limited to such a constitution when the constitution eliminates the engagement between the engaging portion 111 and the recessed portion 28*a* by operating the operation handle 44 by the user or the maintenance person.

Next, an operation when the drum cartridge 270 is mounted into the image forming apparatus 100 will be described. When the drum cartridge 270 is mounted, first, the small door 40 is opened. Then, the drum cartridge 270 is moved along the drum cartridge rail 110 in an arrow A1 direction. This arrow A1 direction is an inserting direction and a mounting direction of the drum cartridge 270.

When the drum cartridge 270 is moved along the drum cartridge rail 110, first, the bottom of the photosensitive drum casing 28 contacts the inclined portion 111*d* of the engaging portion 111. As a result, the flexible portion 111*b* is elastically deformed, so that the engaging projection portion 111*a* is pushed down in a direction crossing the arrow A direction by the bottom of the photosensitive drum casing 28.

Then, when the drum cartridge 270 is further inserted in the arrow A direction, the drum cartridge 270 reaches a position where the recessed portion 28*a* of the photosensitive drum casing 28 and the engaging portion 111*a* oppose each other. At this time, a contact state between the inclined portion 111*d* and the bottom of the photosensitive drum casing 28 is eliminated, so that the flexible portion 111*b* returns to a non-deformation state. Accordingly, the engaging projection portion 111*a* is in an engaged state with the recessed portion 28*a*, so that the drum cartridge 270 is mounted in the image forming apparatus main assembly 100.

Then, after the drum cartridge 270 is mounted, the small door 40 is closed, so that the regulating portion 271*a* of the regulating member 271 moves to a position where the regulating portion 271*a* opposes the contact portion 111*c* of the contact portion 111*c* of the engaging portion 111. Thus, the elastic deformation of the engaging portion 111*b* is limited (prevented), so that movement of the engaging portion 111 in a direction crossing the arrow A direction is prevented.

In this embodiment, a locking force between the engaging portion 111 and the recessed portion 28*a* is set so that an operating force when the drum cartridge 270 is extracted out of the image forming apparatus main assembly 100 is about 10-20N. Here, in the case where the locking force between the engaging portion 111 and the recessed portion 28*a* is excessively strong, operativity when the drum cartridge 270 is extracted out of the image forming apparatus main assembly 100 becomes poor. Further, in the case where the locking force is excessively weak, there is a liability that engagement by the engaging portion 111 is eliminated by vibration and impact by movement of the image forming apparatus main assembly 100 during package shipment of the image forming apparatus main assembly 100. Then, the engagement between the engaging portion 111 and the drum cartridge 270 is eliminated and thus the positioning of the drum cartridge 270 in the image forming apparatus main assembly 100 is eliminated, so that there is a liability that in the image forming apparatus main assembly, the drum cartridge 270 moves. Thus, when the drum cartridge 270 is moved out of the mounting position during the package shipping, the drum cartridge 270 collides against another component part or the like, so that there is a possibility that sliding marks, hitting mark and the like generate on the photosensitive drum 27 and an image quality lowers.

On the other hand, in this embodiment, a constitution in which the image forming apparatus main assembly 100 is provided with the regulating member 271 for regulating (preventing) elimination of engagement between the engaging projection portion 111*a* and the recessed portion 28*a* by the elastic deformation of the flexible portion 111*b* of the engaging portion 111 was employed. Accordingly, elimination of engagement with the engaging portion during the package shipping can be prevented, so that it is possible to prevent a lowering in image quality due to generation of the sliding marks and the hitting marks on the photosensitive drum 27.

Figure 10:
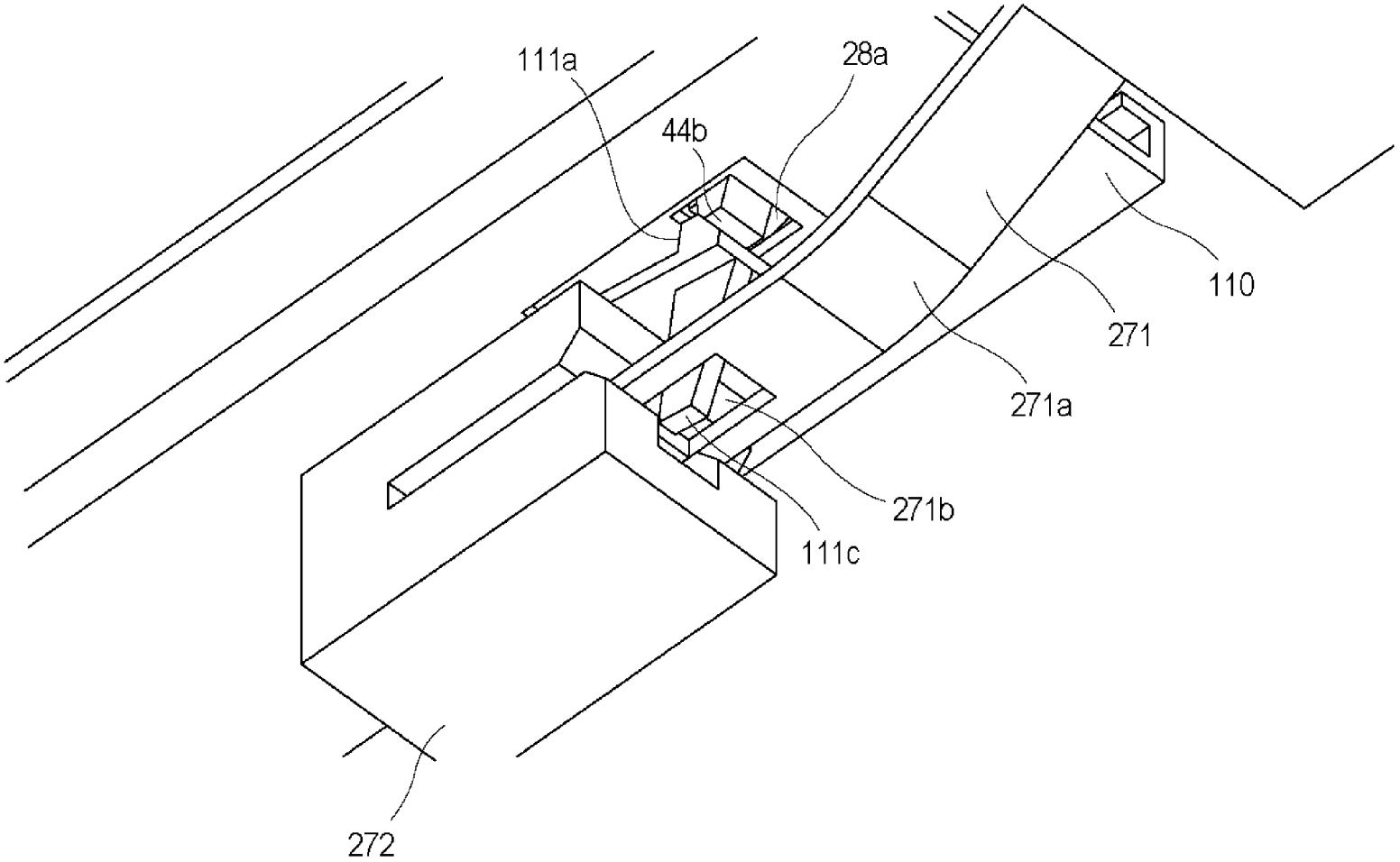
FIG. 10 is an enlarged perspective view showing a regulation-eliminated state of the regulating member.

Next, a deregulating operation of the drum cartridge 270 will be described using FIGS. 9 and 10.

FIG. 9 is a sectional view showing a dismountable state of the drum cartridge 270 from the image forming apparatus main assembly 100. FIG. 10 is an enlarged perspective view showing the regulation-eliminated state of the regulating member 271. Incidentally, FIG. 10 is the perspective view as seen from a back side of the drum cartridge rail 110.

In the case where the drum cartridge 270 is dismounted from the image forming apparatus main assembly 100, as shown in FIG. 9, the small door 40 is opened. Then, with movement of the small door 40 from a closed position to an open position, the regulating member 271 fixed to the small door 40 by the fixing portion 271*c* moves in an arrow A2 direction, of the arrow A direction (FIG. 5), which is a direction in which the drum cartridge 270 is taken out of the image forming apparatus main assembly 100. As a result, the regulating member 271 moves in the arrow A2 direction from a position where the regulating portion 271*a* thereof opposes the contact portion 111*c* of the engaging portion 111 to a position where the regulation eliminating portion 271*b* opposes the contact portion 111*c*. Thereafter, when the operation handle 44 is rotated in an arrow C direction by gripping the grip portion 44*a*, a pressing portion 44*b* of the operation handle 44 pressed down the engaging portion 111 in an arrow D direction. At this time, the regulating member 271 is in the regulation-eliminated state in which the contact portion 111*c* of the engaging portion 111 and the regulation eliminating portion 271*c* oppose each other. Accordingly, as shown in FIGS. 9 and 10, the flexible portion 111*b* is elastically deformed, so that the engaging portion 111 moves to a position where the contact portion 111*c* engages in the regulation eliminating portion 271*b* and the engaging projection portion 111*a* is disengaged from the recessed portion 28*a*.

As a result, the engagement between the drum cartridge 270 and the image forming apparatus main assembly 100 is eliminated, so that the drum cartridge 270 is dismountable in the arrow A2 direction from the image forming apparatus main assembly 100.

In this embodiment, irrespective of an open and closed state of the small door 40, the regulating member 271 is contacted to the supporting member 272 at the supporting portion 271*d*. By this constitution, the regulating member 271 can stably perform movement from the limiting state to the regulation-elimination state in interrelation with the opening operation of the small door 40 and movement from the regulation-eliminated state to the limiting state in interrelation with the small door 40.

As in this embodiment, in the case where the movement of the regulating member 271 is interrelated with the opening and closing operation of the small door 40, when support of the supporting portion 271*d* by the supporting member 272 is eliminated in the open state of the small door 40, there is a liability that the regulating member 271 is deformed when the small door 40 is rotated. This is because the small door 40 is closed in a state in which the supporting portion 271*d* cannot be returned to a state of being supported by the supporting surface 272*a* of the supporting member 272 and contacts another member or the like in the image forming apparatus, and thus the supporting portion 271*d* is pushed in interrelation with the closing operation of the small door 40 and the regulating member 271 is deformed. When the regulating member 271 is deformed, there is a liability that the movement of the regulating member 271 to the limiting state or the regulation-eliminated state in interrelation with the opening and closing operation of the small door 40 cannot be carried out.

However, in this embodiment, the constitution in which the supporting portion 271*d* of the regulating member 271 is supported by the supporting member 272 irrespective of the open and closed state of the small door 40 is employed, and therefore, it is possible to prevent deformation of the regulating member 271 due to the opening and closing operation of the small door 40. Further, the movement of the regulating member 271 in interrelation with the opening and closing operation of the small door 40 can be stably carried out.

Accordingly, by opening the small door 40 when the drum cartridge 270 is dismounted, the regulation by the regulating member 271 can be eliminated with accuracy, so that the engagement between the drum cartridge 270 and the image forming apparatus main assembly 100 can be eliminated.

Further, in the case where the small door 40 is in the closed state, the regulating member 271 is maintained in the limiting state by the small door 40 and the supported by the supporting member 272. Accordingly, engagement elimination of the engaging portion 111 is limited, and therefore, even when vibration and impact are exerted on the drum cartridge 270 by transportation during package shipping, the engagement elimination of the engaging portion 111 can be limited.

Further, in this embodiment, the regulating member 271 is directly fixed to the small door 40 and therefore, there is no component part interposed therebetween, so that the constitution of the regulating member 271 can be simplified. Further, by employing a simple constitution, it is possible to prevent that the movement of the regulating member 271 interrelation with the small door 40 cannot be carried out with accuracy due to accumulation of a tolerance of an interposing component part. Accordingly, by the simple constitution, not only the regulation elimination of the regulating member 271 when the drum cartridge 270 is dismounted can be accurately carried out, but also the engagement of the regulating member 271 with the image forming apparatus main assembly 100 when the drum cartridge 270 is mounted can be accurately carried out.

Incidentally, in this embodiment, a constitution in which the drum cartridge rail 111 and the engaging portion 111 are the same member was described, but the present invention may also be not limited to this constitution. For example, a constitution in which the drum cartridge rail 11 and the engaging portion 111 are separate members may also be employed when the constitution locks the image forming apparatus main assembly 100 and the drum cartridge 270.

In this embodiment described above, a constitution in which the drum cartridge 270 is inserted in and extracted out of the image forming apparatus main assembly 100 was described, but a constitution when the developing cartridge 220 is inserted in and extracted out of the image forming apparatus main assembly 100 may also be made identical to that of the drum cartridge 270 described above.

In the above, a constitution in which the regulation eliminating portion 271*b* is a through hole through which the contact portion 111*c* penetrates was employed, but the present invention may also be not limited to this constitution. For example, a constitution in which the regulation eliminating portion 271*b* may also have a recessed shape, a channel shape, a cut-away shape, a valve shape or the like in cross-section when the constitution is capable of eliminating the engagement of the engaging projection portion 111*a* with the recessed portion 28*a* with no contact of the contact portion 111*c* with the regulating portion 271*c*. Further, a constitution such that the regulating portion 271*c* is retracted from the position of regulating the contact portion 111*c* by an elastic deformation of the regulating member 271 may also be employed.

Further, in this embodiment, a constitution in which the regulating portion 271*a* of the regulating member 271 and the contact portion 111*c* of the engaging portion 111 contact each other was employed, but a constitution in which the engagement elimination of the engaging portion 111 is limited by the contact therebetween may also be not employed. For example, the contact portion 111*c* of the engaging portion 111 in the case where the small door 40 is in the closed state is not always required to contact the regulating portion 271*a* of the regulating member 271, so that a constitution in which the contact portion 111*c* and the regulating portion 271*a* are in contact with each other in the case where the flexible portion 111*b* of the engaging portion 111 is elastically deformed may also be employed. In this case, a distance between the contact portion 111*c* of the engaging portion 111 and the regulating portion 271*a* of the regulating member 271 in the closed state of the small door 40 is needed to be made smaller than a height of the engaging projection portion 111*a* with respect to an upward vertical direction.

As a result, even in a constitution in which the contact portion 111*c* of the engaging portion 111 and the regulating portion 271*a* of the regulating member 271 are in non-contact with each other in the closed state of the small door 40, it is possible to prevent disengagement between the engaging projection portion 111*a* of the engaging portion 111 with the recessed portion 28*a*.

Further, a constitution in which the fixing portion 271*c* of the regulating member 271 is engaged in the unshown boss provided on the small door 40 was employed, but a constitution in which the fixing portion 271*c* is fixed to the small door 40 by another method such as a screw or an adhesive may also be employed when the constitution permits support of one end of the regulating member 271 by the small door 40. At this time, a constitution in which when the regulating portion 271*a* of the regulating member 271 is movable between the regulating position and the regulation eliminating position by the opening and closing operation, the fixing portion 271*c* and the small door are movably fixed may also be employed. For example, a constitution in which a boss is provided on a fixing portion side and a long hole engageable with the boss is provided on the regulating member 271 side and thus the regulating member 271 is supported by the small door 40 may also be employed.

In the above, the constitution in which the regulating member 271 is moved between the regulating position and the regulation eliminating position by the opening and closing operation was employed, but a constitution in which the movement of the regulating member 271 is interrelated with another-shaped member such as a lever-shaped member may also be employed. For example, a constitution in which the movement of the regulating member 271 is interrelated with the opening and closing operation of the outer casing cover may also be employed.

In the above, the constitution in which the regulating member 271 is moved between the regulating position and the regulation eliminating position by the opening and closing operation of the small door 40 was employed, but a constitution in which the regulating member 271 is moved between the regulating position and the regulation eliminating position by changing the flexed state of the small door 40 may also be employed. For example, a constitution in which the regulating portion 271*a* is sufficiently spaced from the contact portion 111*c* by increasing a flexure amount between the fixing portion 271*c* and the supporting portion 271*d* during opening of the small door 40 may also be employed.

In the above, the constitution in which the supporting portion 271*d* of the regulating member 271 is slidably (movably) supported by the supporting surface 272*a* without being dismounted from the supporting member 272 by having a sufficient length was employed. The present invention is not limited to this constitution, but may also be employ another constitution when the constitution does not prevent the sliding (movement) on the supporting surface 272*a*. For example, a constitution in which a boss is provided on the supporting member 272 and a long hole loosely engageable with the boss is provided in the supporting portion 271*d* and thus the supporting portion 271*d* is slidably fixed on the supporting member 272 may also be employed. By employing this constitution, it is possible to prevent that the supporting portion 271*d* is dismounted from the supporting surface of the supporting member 272 by the opening and closing operation of the small door 40.

(Air Flow Portion)

Figure 11:
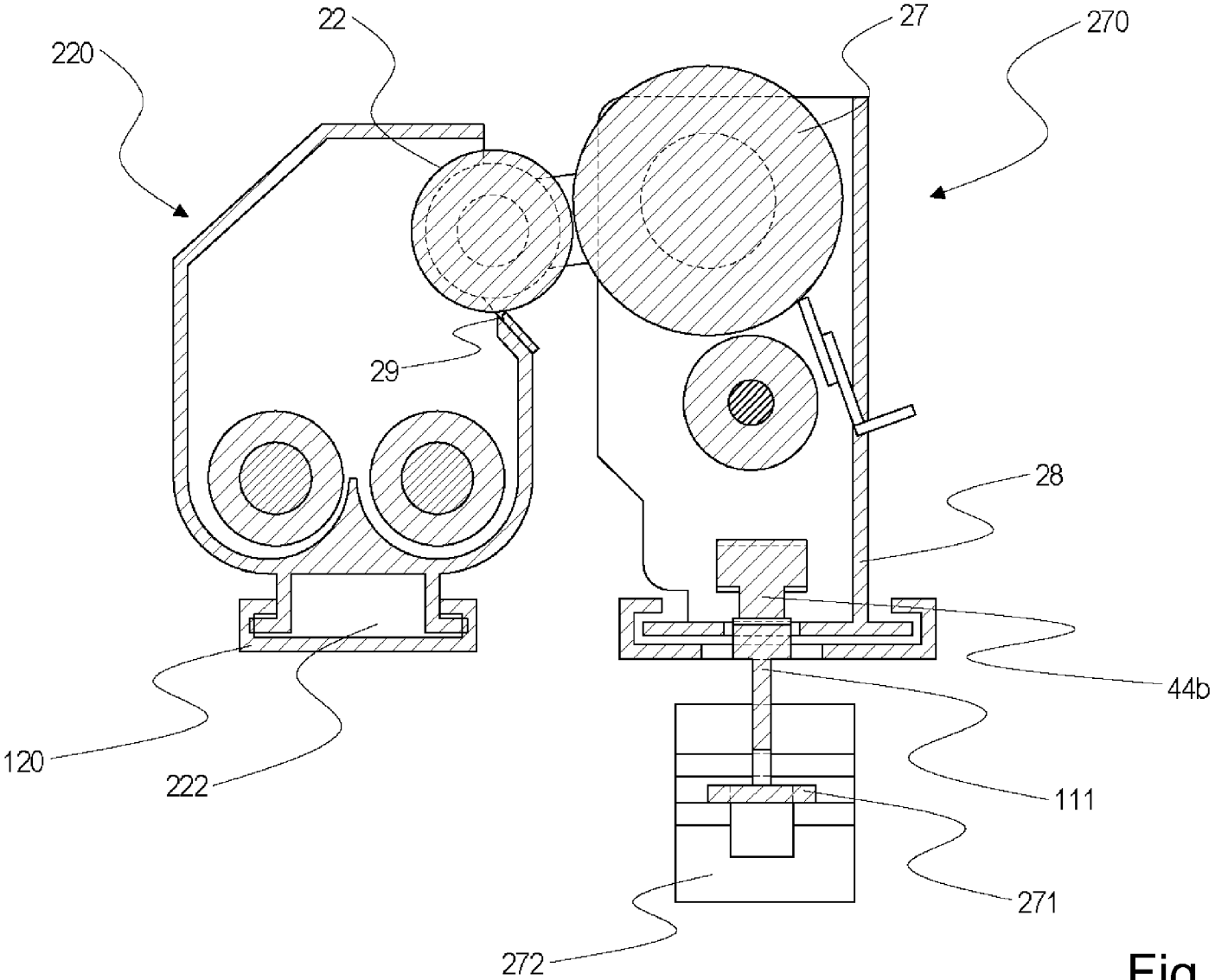
FIG. 11 is a sectional view of the drum cartridge taken along X-X line of FIG. 4.

Next, a constitution of an air flow portion 222 in the developing cartridge 220 will be described. FIG. 11 is a sectional view taken along an X-X line of FIG. 4.

As is the above-described constitution, in the case where the developing blade 29 always contacts the developer on the developing sleeve 22 for regulating a coating amount of the developer, a temperature in the developing cartridge 220 tends to increase. There is a liability that the toner accommodated in the developing cartridge 220 becomes an agglomeration with an increasing temperature and causes an image defect, and therefore, it is desired that a cooling constitution is provided so that the temperature in the developing cartridge 220 does not excessively increases. However, an air flow portion having the cooling constitution is provided in the neighborhood of the developing blade 29 or an exposed portion of the developing sleeve 22 of the developing cartridge 220, there is a liability of scattering of the toner.

Therefore, in this embodiment, in order to cool the developing cartridge 220 while preventing the scattering of the toner, an air flow portion 222 is provided between the developing cartridge 220 and the developing (cartridge) rail 120 as shown in FIG. 11. By this constitution, a cool air can pass through the bottom of the developing cartridge 220, and therefore, it is possible to suppress temperature rise of the developing cartridge 220. Further, it is possible to prevent and image defect due to the temperature rise of the developing cartridge 220. Incidentally, the air flow portion 222 for cooling the developing cartridge 220 may preferably have a constitution in which the air flow portion 222 is hermetically sealed to the extent possible in order to prevent loss of speed and volume of air.

In this embodiment, as shown in FIG. 11, the air flow portion 222 of the developing cartridge 220 was provided at a position where the air flow portion 222 does not interfere with a movable region of the regulating member 271 for preventing the movement of the engaging portion 111 of the drum cartridge 270. Accordingly, an outflow of the air, flowing through the air flow portion 222, to an outside of the air flow portion 222 decreases compared with the case where the air flow portion 222 is provided at a position where the air flow portion interferes with the movable region of the regulating member 271, and therefore, a cooling efficiency can be improved.

Second Embodiment

Figure 12:
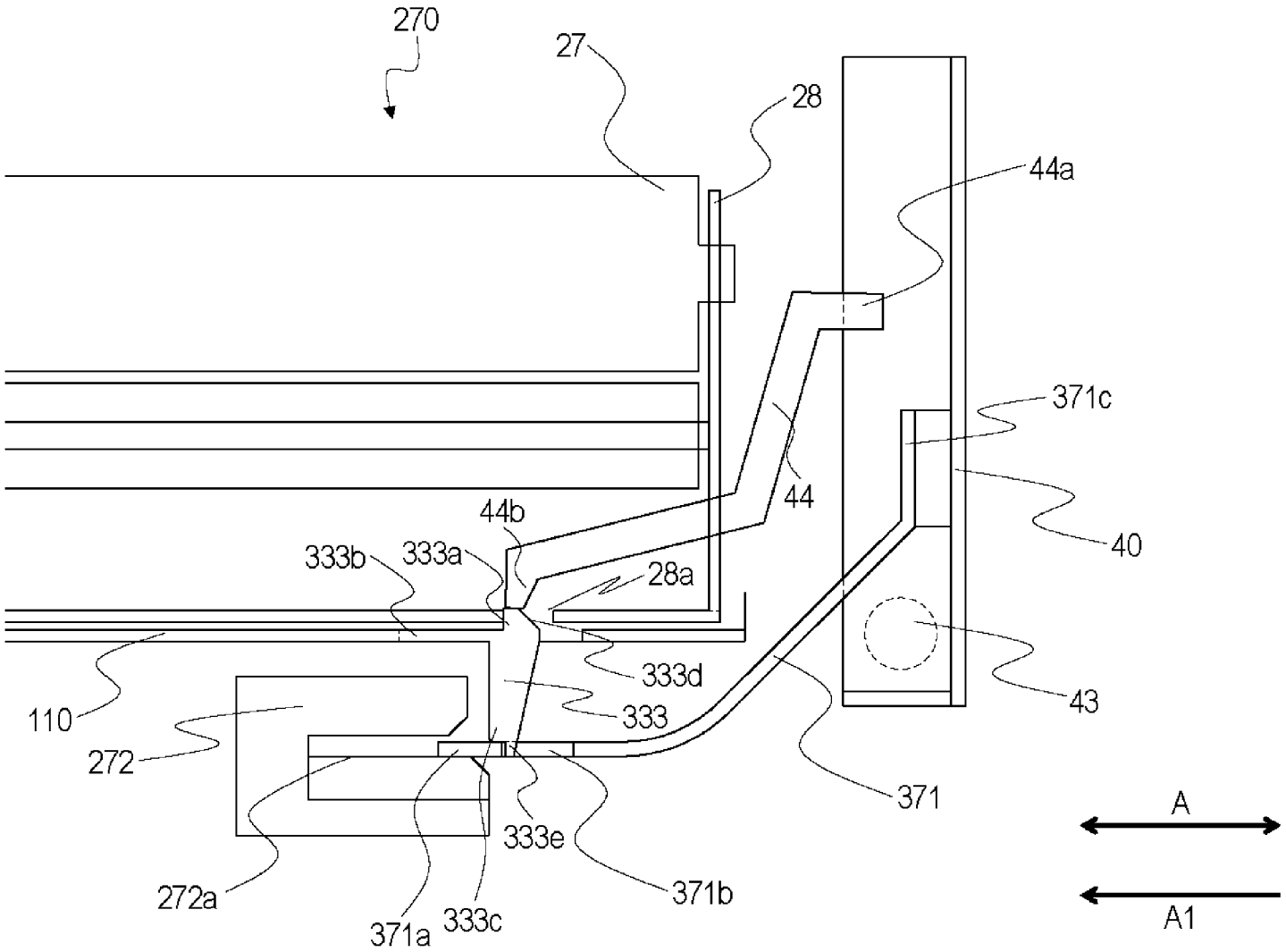
FIG. 12 is a sectional view showing a mounted state of a drum cartridge in Second Embodiment.
Figure 13:
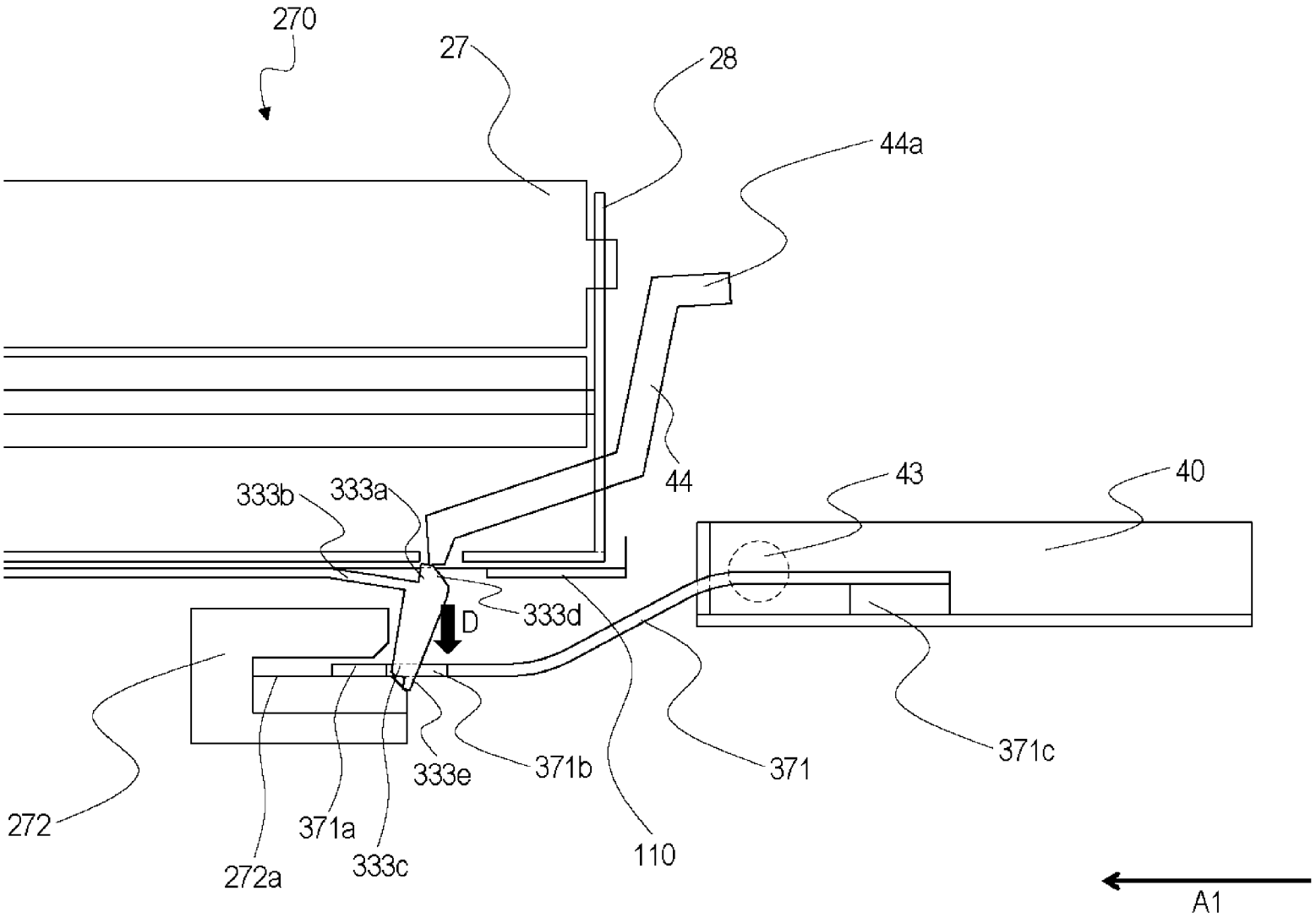
FIG. 13 is a sectional view showing a state in which the drum cartridge is dismountable from an image forming apparatus main assembly in Second Embodiment.

Next, Second Embodiment will be described using FIGS. 12 and 13. FIG. 12 is a sectional view showing a mounted state of the drum cartridge 270 in this embodiment. FIG. 13 is a sectional view showing a state in which the drum cartridge 270 is dismountable from the image forming apparatus main assembly 100 in this embodiment.

In this embodiment, a constitution in which a locking portion 333 different in shape from the engaging portion 111 in First Embodiment is provided is employed. Further, a constitution in which a regulating member 371 different in fixing position to the small door 40 from the regulating member 271 in First Embodiment is provided is employed. Here, this embodiment has the same constitution as First Embodiment except for the constitutions of the locking portion 333 and the regulating member 371, and therefore, constituent elements in this embodiment are represented by the same reference numerals or symbols and will be omitted from description. Incidentally, the locking portion 333 is an example of the engaging portion, and the regulating member 371 is an example of the regulating member.

As shown in FIG. 12, the locking portion 333 of the drum cartridge rail 110 has a projected shape by an elastic snap-fitting portion and includes an engaging projection portion 333*a*, a flexible portion 333*b*, a contact portion 333*c*, an inclined portion 333*d* and an engaging-in portion 333*e*. The engaging projection portion 333*a* projects in a direction crossing the mounting and dismounting direction of the drum cartridge 270 so as to engage in and engage with the recessed portion 28*a* of the drum cartridge 270.

When the drum cartridge 270 is mounted in and dismounted from the image forming apparatus main assembly 100, the flexible portion 333*b* is elastically deformable so that the engaging projection portion 333*a* is movable in a direction crossing the mounting and dismounting direction of the drum cartridge 270 relative to the drum cartridge rail 110. That is, a constitution in which the flexible portion 333*b* flexes in the direction crossing the mounting and dismounting direction relative to the drum cartridge rail 110 by elastic deformation thereof and in which the engaging projection portion 333*a* and the recessed portion 28*a* are engaged and disengaged with each other.

The contact portion 333*c* moves with movement of the engaging projection portion 111*a* and is contactable to a supporting and regulating portion 371*a* of the regulating member 371 in the closed state of the small door 40.

The inclined portion 333*d* has an inclined surface provided for pushing down the engaging projection portion 333*a* in contact with the bottom of the photosensitive drum casing 28 so as to flex the engaging projection portion 333*a* in the direction crossing the mounting and dismounting direction when the drum cartridge 270 is mounted. The engaging-in portion 333*e* projects downwardly in the direction crossing the insertion and extraction direction so as to always engage in a regulation eliminating portion 371*b* described later.

The locking (engaging) portion 333 is an example of the engaging member. Further, when the drum cartridge 270 is inserted in and extracted out, the flexible portion 333*b* elastically deforms relative to the drum cartridge rail 110, so that the engaging portion 333*a* and the recessed portion 28*a* are engaged and disengaged with each other.

Further, the regulating member 371 includes a supporting and regulating portion 371*a* for preventing movement of the engaging projection portion 333*a* by elastic deformation of the flexible portion 333*b*, and includes a regulation (prevention) eliminating portion 371*b* for eliminating the prevention of the movement, and a fixing portion 371*c* fixed to the small door 40. The regulating member 371 is fixed to the small door 40 similarly as in First Embodiment, but a position of the fixing portion 371*c* fixed to the small door 40 is closer to the door rotation shaft 43 than the fixing portion 271*c* in First Embodiment is. That is, the regulating member 371 in this embodiment is fixed to the small door 40 at a position closer to the door rotation shaft 43 than the regulating member 271 in First Embodiment is.

Also in this embodiment, the regulating member 371 is fixed to the small door 40 at the fixing portion 371*c* which is one end thereof. Further, the supporting and regulating portion 371*a* as the other end of the regulating member 271 is slidable movable on a supporting surface 272*a* of the supporting member 272 in the arrow A direction which is the insertion and extraction direction of the drum cartridge 270 by the opening and closing operation of the small door 40.

Also in this embodiment, the supporting member 272 is provided in the image forming apparatus main assembly 100 and is disposed below the drum cartridge rail 110 and the engaging portion 333 on a side below the rotation shaft 43 of the small door 40 with respect to a vertical direction. Further, the fixing portion 371*c* is provided above the rotation shaft 43 of the small door 40 with respect to the vertical direction on a side above the engaging portion 333 with respect to the vertical direction. With respect to the insertion and extraction direction, the supporting member 272 is provided inside the engaging portion 111 in the image forming apparatus main assembly 100, and the rotation shaft 43 of the small door 40 and the fixing portion 371*c* are provided outside the engaging portion 333 in the image forming apparatus main assembly 100.

However, in this embodiment, the fixing position of the regulating member 371 to the small door 40 is closer to the door rotation shaft 43 than that in First Embodiment is, and therefore, the movement direction of the regulating member 371 with the opening and closing operation of the small door 40 is opposite to that in First Embodiment. That is, in this embodiment, when the small door 40 is moved from the closed position shown in FIG. 12 to the open position shown in FIG. 13, the supporting and regulating portion 371*a* of the regulating member 371 fixed to the small door 40 by the fixing portion 371*c* is moved in the arrow A1 direction which is the mounting direction of the drum cartridge 270. Then, when the small door 40 is moved from the open position shown in FIG. 13 to the closed position shown in FIG. 12, the supporting and regulating position 371*a* of the regulating member 371 is moved in a direction opposite to the arrow A1 direction which is the dismounting direction of the drum cartridge 270. Thus, the movement direction in this embodiment is different from that in First Embodiment. Accordingly, in First Embodiment, the constitution in which the regulating portion 271*a* is provided between the fixing portion 271*c* and the regulation eliminating portion 271*b* was employed, but in this embodiment, the constitution in which the regulation eliminating portion 371*b* is provided between the fixing portion 371*c* and the supporting and regulating portion 371*a* was employed. That is, in this embodiment, the regulating portion 271*a* regulating the movement of the engaging portion 111 and the supporting portion 271*d* supported by the supporting member 272 in First Embodiment is constituted as the same portion constituting the supporting and regulating portion 371*d*.

Further, in this embodiment, the constitution in which the supporting and regulation portion 371*a* of the regulating member 371 is supported by the supporting member 272 irrespective of the open and closed state of the small door 40 is employed, and therefore, it is possible to prevent deformation of the regulating member 371 due to the opening and closing operation of the small door 40. Further, the movement of the regulating member 371 in interrelation with the opening and closing operation of the small door 40 can be stably carried out.

Accordingly, by opening the small door 40 when the drum cartridge 270 is dismounted, the regulation by the regulating member 371 can be eliminated with accuracy, so that the engagement between the drum cartridge 270 and the image forming apparatus main assembly 100 can be eliminated.

Further, in the case where the small door 40 is in the closed state, the regulating member 371 is maintained in the limiting state by the small door 40 and the supported by the supporting member 272. Therefore, engagement elimination of the locking portion 333 is limited, and therefore, even when vibration and impact are exerted on the drum cartridge 270 by transportation during package shipping, the engagement elimination of the locking portion 333 can be limited.

Further, in this embodiment, the regulating member 371 is directly fixed to the small door 40 and therefore, there is no component part interposed therebetween, so that the constitution of the regulating member 371 can be simplified. Further, by employing a simple constitution, it is possible to prevent that the movement of the regulating member 371 interrelation with the small door 40 cannot be carried out with accuracy due to accumulation of a tolerance of an interposing component part. Accordingly, not only the regulation elimination of the regulating member 371 when the drum cartridge 270 is dismounted can be accurately carried out, but also the engagement of the regulating member 371 with the image forming apparatus main assembly 100 when the drum cartridge 270 is mounted can be accurately carried out.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-183511 filed on Sep. 25, 2017, which is hereby incorporated by reference herein in its entirety.

What is claimed is:

1. An image forming apparatus comprising:

a main assembly including a main assembly connecting portion and a driving source configured to generate a driving force for rotating said main assembly connecting portion;

a cartridge including a cartridge connecting portion configured to connect with said main assembly connecting portion, and a rotatable member carrying a developer and configured to rotate by receiving the driving force through said cartridge connecting portion; wherein said cartridge is mountable to and dismountable from said main assembly by being inserted into and extracting out of said main assembly in a rotational axis direction of said rotatable member;

a rotationally movable member mounted in said main assembly so as to be rotationally moved between a first position located on an insertion and extraction path of said cartridge and a second position retracted from the insertion and extraction path;

an engaging portion provided in said main assembly and engageable with said cartridge on the insertion and extraction path so that said cartridge is in a mounting position where said main assembly connecting portion and said cartridge connecting portion connect with each other in an insertion and extraction direction of said cartridge, wherein said engaging portion is elastically deformable so as to be retracted from the insertion and extraction path; and a flexible member supported by said rotationally movable member and said main assembly in a state in which said flexible member is flexed, said flexible member integrally including: (i) a first supported portion supported by said rotationally movable member, (ii) a second supported portion supported by said main assembly, and (iii) a regulating portion configured to regulate elastic deformation of said engaging portion in contact with said engaging portion, wherein a position of said regulating portion of said flexible member relative to said engaging portion is changeable by a change in a flexed state of a portion of said flexible member between said first supported portion and said second supported portion, in interrelation with a change in relative position between said first supported portion and said second supported portion with rotational movement of said rotationally movable member, wherein said flexible member is supported by said first supported portion and said second supported portion such that the portion of said flexible member between said first supported portion and said second supported portion is in a curved state in a case in which said rotationally movable member is positioned at the second position, wherein said regulating portion is arranged between said first supported portion and said second supported portion with respect to the rotational axis direction of said rotatable member irrespective of a position of said rotationally movable member, and wherein when said rotationally movable member is in the first position, said regulating portion is in a regulating position to limit the elastic deformation of said engaging portion.

2. An image forming apparatus according to claim 1, wherein said cartridge includes an operating portion operated when said cartridge is mounted in and dismounted from said main assembly, and said engaging portion elastically deformed so as to be retracted from the insertion and extraction path by operation of said operating portion, and engagement between said main assembly and said cartridge is eliminated.

3. An image forming apparatus according to claim 1, wherein said main assembly further includes a guiding member configured to guide movement of said cartridge in the insertion and extraction direction, wherein said cartridge includes a recessed portion engageable with said engaging portion, wherein said engaging portion is provided on said guiding member, and wherein said guiding member includes a flexible portion capable of elastically deforming said engaging portion so as to be retracted from the insertion and extraction path.

4. An image forming apparatus according to claim 3, wherein said engaging portion is provided movably in a direction in which said engaging portion is retracted from the insertion and extraction path by flexure of said flexible portion, and said engaging portion includes a contact portion configured to limit elastic deformation of said flexible portion by contact with said regulating portion.

5. An image forming apparatus according to claim 4, wherein said flexible member is provided with a hole which moves to a position opposing said contact portion with movement of said rotationally movable member includes a permitting portion permitting elastic deformation of said engaging portion, a position of said permitting portion changing with changes in a flexed state of a portion between said first supported portion and said second supported portion, and wherein said permitting portion is in a position where said permitting portion opposes said engaging portion in a case in which said rotationally movable member is in the second position.

6. An image forming apparatus according to claim 5, wherein said contact portion includes an engaging portion engaging in said hole irrespective of a position of said regulating portion.

7. An image forming apparatus according to claim 1, wherein said first supported portion is fixed to said rotationally movable member so that when said rotationally movable member moves from the first position to the second position, said regulating portion moves in an extraction direction of said cartridge and contacts said engaging portion and retracts from a regulating position where elastic deformation of said engaging portion is regulated and by the retraction of said regulating portion, regulation of the elastic deformation of said engaging portion by said regulating portion is eliminated.

8. An image forming apparatus according to claim 1, wherein said first supported portion is fixed to said rotationally movable member so that when said rotationally movable member moves from the first position to the second position, said regulating portion moves in an insertion direction of said cartridge and contacts said engaging portion and retracts from a regulating position where elastic deformation of said engaging portion is regulated and by the retraction of said regulating portion, regulation of the elastic deformation of said engaging portion by said regulating portion is eliminated.

9. An image forming apparatus according to claim 1, wherein said rotatable member is a developing sleeve carrying the developer and configured to develop an electrostatic latent image formed on a photosensitive drum, and wherein said cartridge is a developing cartridge including said developing sleeve.

10. An image forming apparatus according to claim 1, wherein said rotatable member is a photosensitive drum carrying the developer and configured to form an image, and wherein said cartridge is a drum cartridge including said photosensitive drum and a charging roller configured to electrically charge said photosensitive drum to a uniform negative polarity potential.

11. An image forming apparatus according to claim 10, further comprising:

a developing cartridge including a developing sleeve configured to develop an electrostatic latent image formed on said photosensitive drum and mountable to and dismountable from said main assembly; and a developing rail configured to guide movement of said developing cartridge in a mounting and dismounting direction of said developing cartridge and configured to form an air flow, wherein said flexible member is supported by said rotationally movable member and said main assembly at a position where said flexible member is in non-interference with the air flow.

12. An image forming apparatus according to claim 5, wherein said permitting portion includes a through hole portion which the engaging portion elastically deformed penetrates in a case in which said rotationally movable member is in the second position.

13. An image forming apparatus according to claim 5, wherein said permitting portion includes a recessed portion which the engaging portion elastically deformed inserts in a case in which said rotationally movable member is in the second position.

* * * * *